US008220194B2

(12) United States Patent
Crow

(10) Patent No.: US 8,220,194 B2
(45) Date of Patent: Jul. 17, 2012

(54) SLEEVE AND METHOD FOR INCREASING RIFLE ACCURACY

(76) Inventor: Larry P. Crow, Bogard, MO (US)

( * ) Notice: Subject to any disclaimer, the term of this patent is extended or adjusted under 35 U.S.C. 154(b) by 0 days.

(21) Appl. No.: 12/865,696

(22) PCT Filed: Jan. 30, 2009

(86) PCT No.: PCT/US2009/032596

§ 371 (c)(1),
(2), (4) Date: Jul. 30, 2010

(87) PCT Pub. No.: WO2009/097504

PCT Pub. Date: Aug. 6, 2009

(65) Prior Publication Data

US 2010/0307044 A1 Dec. 9, 2010

Related U.S. Application Data

(60) Provisional application No. 61/025,382, filed on Feb. 1, 2008.

(51) Int. Cl.
*F41A 21/00* (2006.01)

(52) U.S. Cl. ..... 42/75.02; 42/75.03

(58) Field of Classification Search ..... 42/75.01, 42/75.02, 75.03
See application file for complete search history.

(56) References Cited

U.S. PATENT DOCUMENTS 2,717,465 A * 9/1955 Clark, Jr. et al. ..... 42/75.01
2,795,881 A * 6/1957 Bellows ..... 42/75.02
5,412,895 A * 5/1995 Krieger ..... 42/75.02

* cited by examiner

*Primary Examiner* — Gabriel Klein
(74) *Attorney, Agent, or Firm* — Joseph S. Heino; Patrick M. Bergin

(57) ABSTRACT

The present invention provides for a sleeve that is mountable within a rifle stock. The sleeve includes a central aperture, one end of which is threaded and is adapted to receive a like-threaded male portion of an action. The action is of the type that includes a female threaded portion, this portion being configured to receive the threaded male portion of a rifle barrel. In this configuration, the sleeve is in direct contact with the stock, the action is in direct contact with the sleeve, and the barrel is in direct contact with the action. However, neither the barrel nor the action is in direct contact with the stock. As such, both the barrel and the action are 'floated' within the rifle assembly. In an alternative embodiment, the sleeve may be fabricated with the action such that the sleeve and action form a single integrated element.

4 Claims, 4 Drawing Sheets

SLEEVE AND METHOD FOR INCREASING RIFLE ACCURACY

This application claims the benefit and priority of U.S. Provisional Patent Application No. 61/025,382 filed Feb. 1, 2008.

FIELD OF THE INVENTION

This invention relates generally to rifles, both of the sporting type and the military type, where the rifle barrel is cantilevered from the rifle action. It also relates generally to methods and devices that are used to increase the accuracy of projectiles fired from such rifles. More specifically, it relates to a device and method whereby both the action and the barrel are cantilevered within the rifle stock such that vibrations and harmonics that result from the firing of a projectile are dampened.

BACKGROUND OF THE INVENTION

In the art of sport and military rifle shooting, consistent accuracy is a primary goal of the marksman. Various rifle configurations and methods have been devised for minimizing factors that adversely affect shooting accuracy. One such configuration that is known in the art is to cantilever the rearward-most portion of the barrel from the rifle action. This type of configuration is used to reduce the adverse effects of barrel vibration and harmonics. In this type of configuration, the barrel is "floated" within the stock because the barrel has no hard, physical connection to the stock. In the experience of this inventor, however, there is an additional s method and device that can be used to reduce the adverse effects of barrel vibration and harmonics and to increase the accuracy and consistency in striking a target with a projectile, which method and device are novel in the art.

Accordingly, it is an object of the present invention to provide a new and useful device and method for reducing the adverse effects of barrel vibration and harmonics when the rifle is fired. It is another object to provide such a device and method whereby the accuracy and consistency in striking a target with a projectile are increased. It is still another object to provide such a device and method whereby a minimal number of elements are required. It is yet another object to provide such a device whereby the device can be easily mounted within a rifle stock and whereby a conventional telescopic sight can be added to the device as desired or required by the shooter.

SUMMARY OF THE INVENTION

The apparatus and method of the present invention has obtained these objects. It provides for a sleeve that is mountable within a rifle stock. The sleeve includes a central aperture one end of which is threaded and is functionally adapted to receive a like-threaded male portion of an action within it. The action is of the type that includes a female threaded portion, this portion being configured to receive the threaded male portion of a rifle barrel within it. In this configuration, the sleeve is in direct contact with the stock, the action is in direct contact with the sleeve, and the barrel is in direct contact with the action. However, neither the barrel or the action are in direct contact with the stock. As such, both the barrel and the action are "floated" within the rifle assembly. In an alternative embodiment, the sleeve may be fabricated with the action such that the sleeve and action form a single integrated element.

The foregoing and other features of the device and method of the present invention will be apparent from the detailed description that follows.

DETAILED DESCRIPTION

Figure 1:
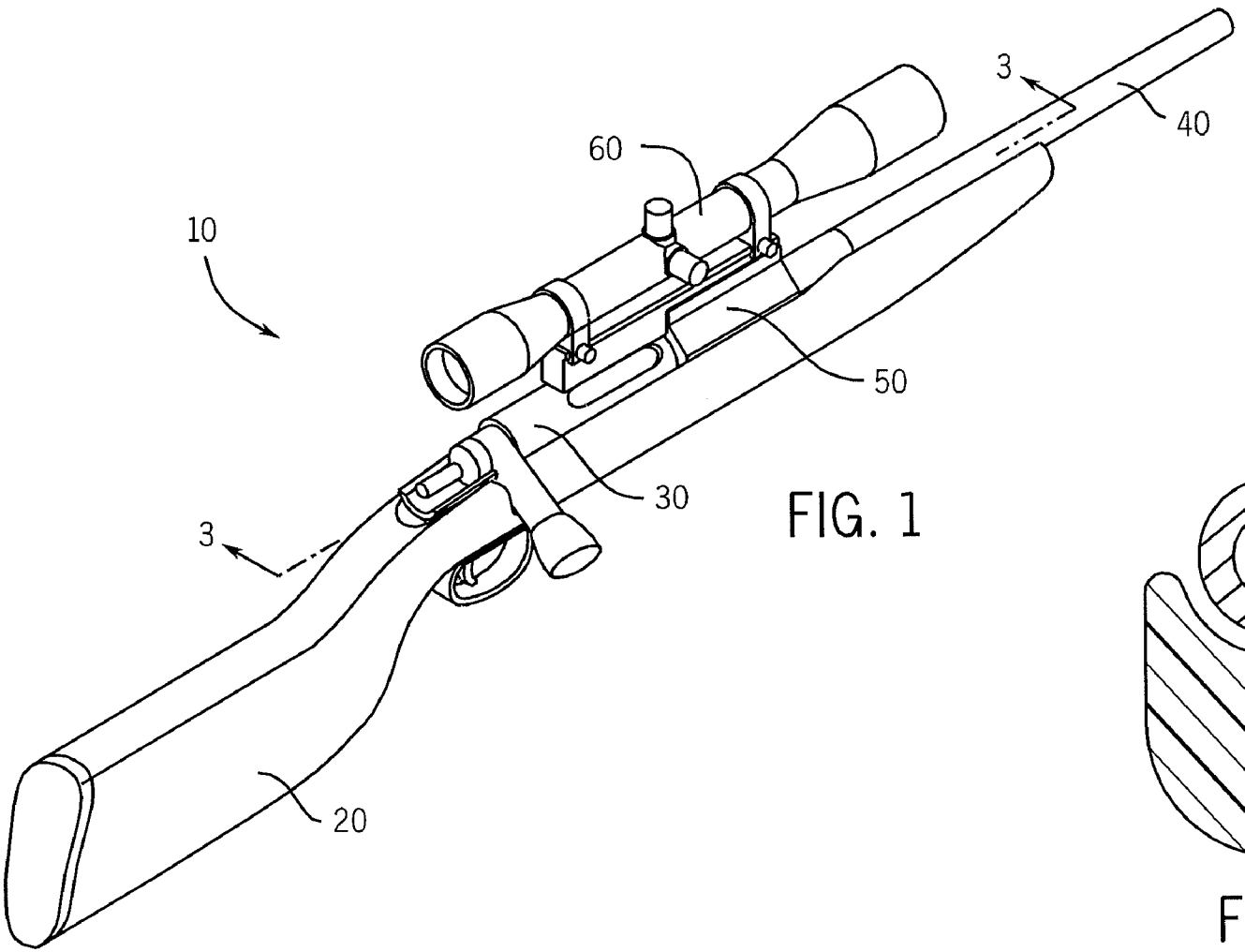
FIG. 1 is a rear, top and side perspective view of a rifle using a sleeve constructed in accordance with the present invention.

Referring now to the drawings in detail wherein like numbers represent like elements throughout, FIG. 1 illustrates a perspective view of a rifle assembly, generally identified 10, as it would be constructed in accordance with the prior art. As shown, the assembly 10 includes a rifle stock 20, a rifle action 30, a rifle barrel 40 and a sleeve, generally identified 50, the sleeve 50 as illustrated being but one embodiment of the present invention. A rifle scope 60 is also shown.

It is to be understood that the sleeve 50 and method of the present invention is not limited to the bolt action platform illustrated. The sleeve 50 and the method of the present invention could be utilized in automatic and semi-automatic rifle platforms as well without deviating from the scope of the present invention.

Figure 4:
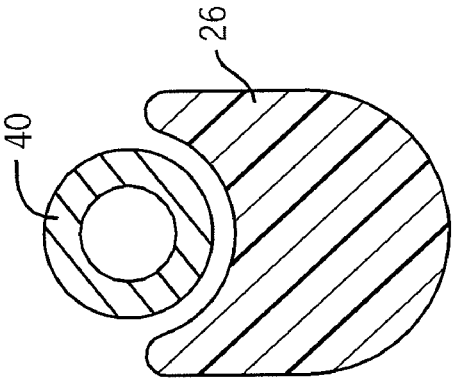
FIG. 4 is a front elevational and cross-sectioned view of the barrel and stock taken along line 4-4 of FIG. 3.
Figure 2:
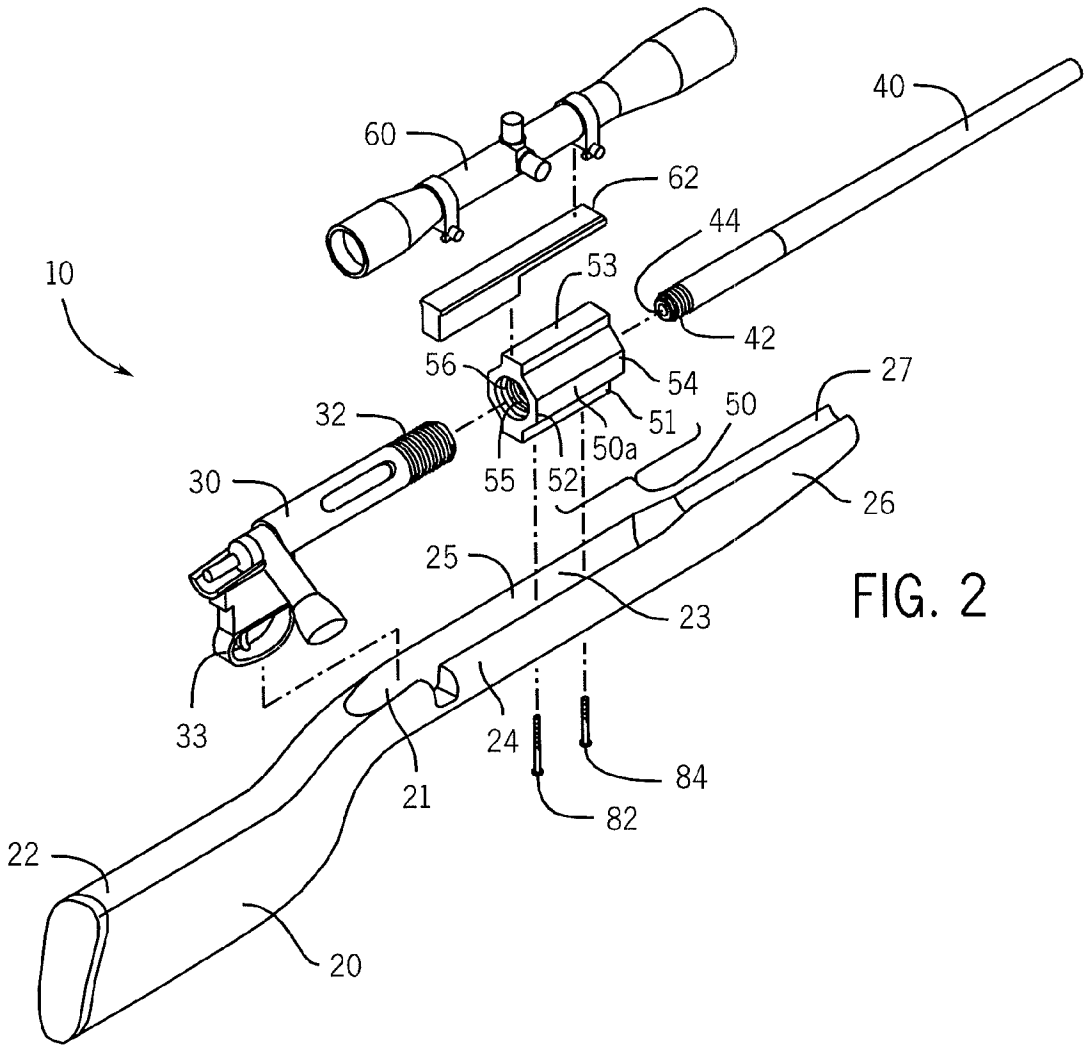
FIG. 2 is an exploded view similar to that shown in FIG. 1.

Referring now to FIG. 2, it is a drawing similar to FIG. 1 but illustrating the rifle assembly 10 in an exploded view. As shown, the rifle stock 20 includes a proximal shoulder rest portion 22, a medial portion 24 and a distal grip portion 26. Configured within the upper surface of the stock 20 is a slot 25. The slot 25 includes a proximal portion 21 within which the rifle action 30 is positioned. The proximal slot portion 21 extends fully through the stock 20 such that the trigger portion 33 of the action 30 protrudes from beneath the stock 20. The slot 25 further includes a distal portion 27 above which is positioned the cantilevered barrel 40. See also FIG. 4. Finally, the slot 25 includes a medial slot portion 23. The sleeve 50 in accordance with the present invention is functionally adapted to be mounted within the medial slot portion 23 of the stock 20. A scope mount 62 and scope 60 are functionally adapted to be mounted to the sleeve 50.

Although the sleeve 50 that is illustrated in FIGS. 1 and 2 is shown to be a somewhat tubular structure having an octagonal outer profile, it is to be understood that other profiles could also be made without deviating from the scope of the present invention, each such profile falling within the scope of the present invention. Such profiles could be round, polygonal, or even a combination of such profiles.

As shown in FIG. 2, it will be seen that the sleeve 50 comprises a sleeve body **50*a* that includes a bottom portion 51 and an upper portion 53. Additionally, the sleeve body 50*a* includes a rearward portion 52 and a forward portion 54. The sleeve body 50*a* further includes a substantially centrally-disposed aperture 56, the aperture having an internally-threaded rearward portion 55 and a forward portion 57. See also FIG. 3 which is a further enlarged and cross-sectioned view of the sleeve 50 that is constructed in accordance with the present invention. The sleeve body 50***a* also includes a pair of threaded apertures 58, 59 that are defined vertically within the bottom portion 51 of the sleeve 50.

In application, the threaded male portion 32 of the action 30 is threadably received within the rearward threaded portion 55 of the sleeve body 50*a*, thereby securing the action 30 to the sleeve body 50*a*. The rearward threaded portion 42 of the barrel 40 is threadably received within the threaded portion 34 of the action 30. The action 30 is retained in position within the sleeve 50 by means of a first fastener 82 that is threadably received by the rearward-most sleeve aperture 58 and by a like-threaded aperture 38 that is defined within the action 30. The sleeve 50 is further secured to the stock 20 by means of a second fastener 84 that is threadable received by the forward-most sleeve aperture 59. A scope mount 62 is also attachable to the upper portion 53 of the sleeve and a telescopic lens assembly 60 can be secure to the mount 62, thus further increasing the ability of the marksman to hit his or her target.

In an alternative embodiment, the action 30 would be integrally formed with the sleeve 50, or vice versa, in which case the step of threadably attaching the threaded male portion 32 of the action 30 to the threaded portion 55 of the sleeve 50 would be eliminated. Indeed, the threaded portions 32, 55 would then be eliminated altogether, but the other steps as mentioned above would remain essentially the same. This alternative embodiment is illustrated in FIG. 5 and will be discussed later in this detailed description.

Figure 3:
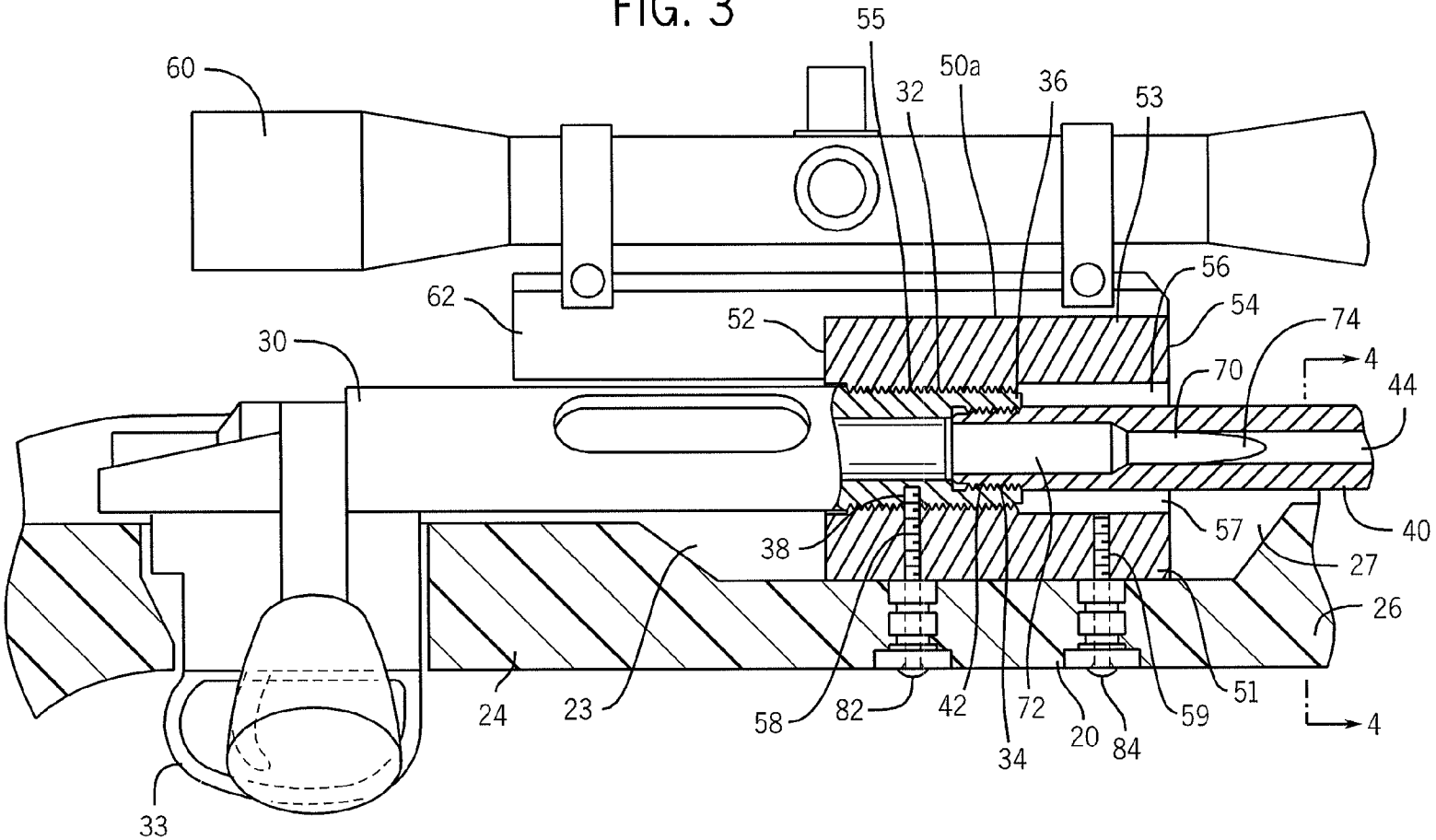
FIG. 3 is an enlarged side elevational and partially cross-sectioned view of the sleeve shown in FIG. 1 taken along line 3-3 of FIG. 1.

Referring again to FIG. 3, it will be understood that the barrel 40 "floats" by means of its cantilevered position off the forward-most portion 36 of the action 30. That is, the barrel 40 has no direct contact with any component other than the action 30. Similarly, it will be understood that the action 30 also "floats" by means of its cantilevered position off the rearward-most portion 52 of the sleeve 50. That is, other than its contact with the barrel 40, the action 30 has no direct contact with any component other than the sleeve 50. Reference to FIG. 3 also illustrates the clearances that exist between the action 30 and the stock 20, between the barrel 40 and the stock 20, and between the barrel 40 and the sleeve 50.

As a rifle round 70 is chambered within the action 50 and the s barrel 40, it will be seen that the round 70 comprises a casing 72 that is filled with an explosive charge (not shown) and a projectile 74. The projectile 74 is shaped such that it is capable of travelling through and being guided by the bore 44 of the rifle barrel 40 until the projectile 74 exits the barrel 40 on its way to its target. At the time of firing of the round 70 by means of the action 30, the vibrations and harmonics that are generated by the explosive charge within the casing 72 are minimized such that the projectile 74 will be true to its target and accuracy is enhanced.

Figure 5:
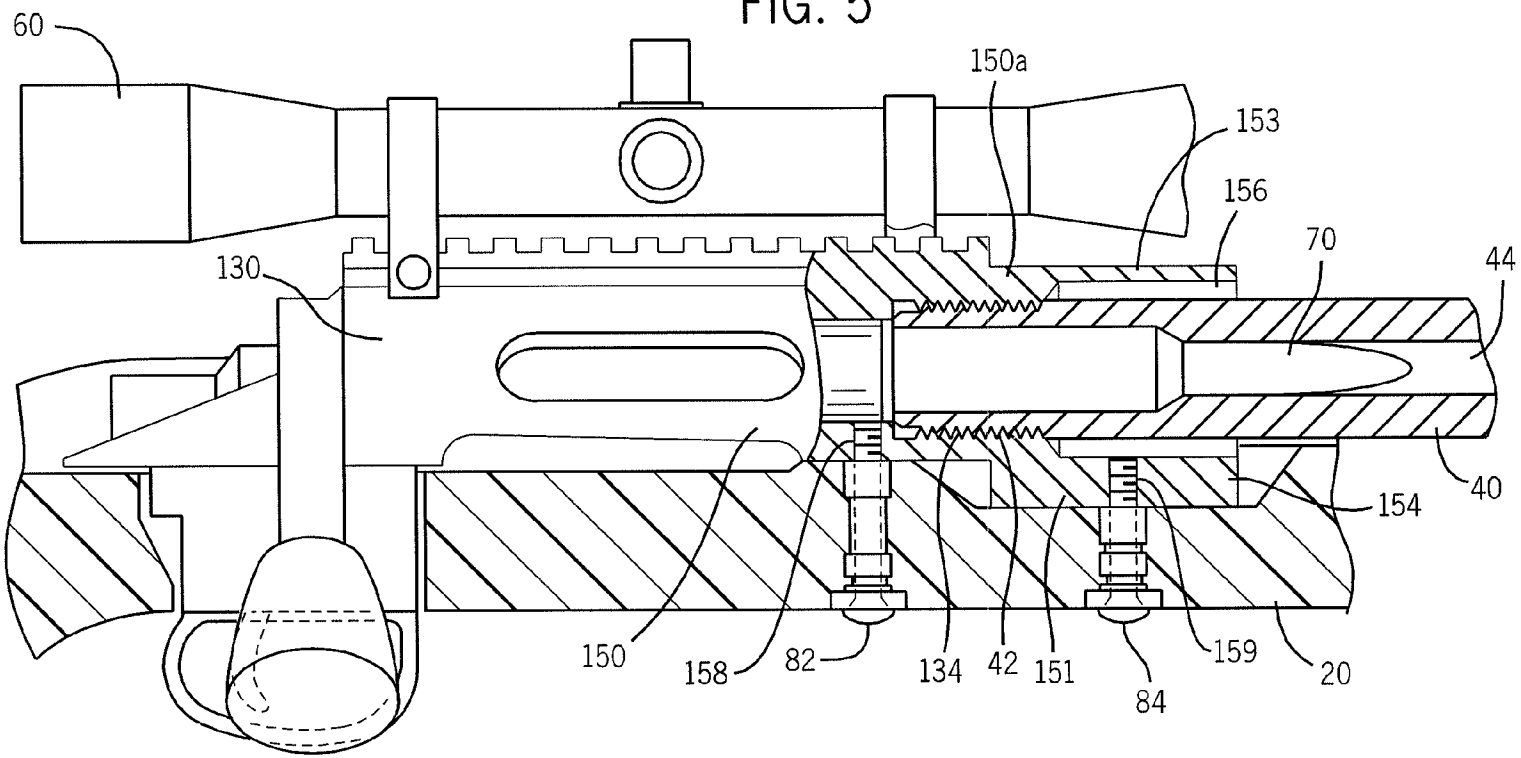
FIG. 5 is an enlarged side elevational and partially cross-sectioned view of an alternative embodiment of the sleeve of the present invention showing the rifle action being integrally formed with the sleeve.

As alluded to previously, an alternative embodiment of the sleeve 150 is illustrated in FIG. 5. As shown, the alternative embodiment of the sleeve 150 comprises a sleeve body 150*a* that includes a bottom portion 151 and an upper portion 153. Additionally, the sleeve body 150*a* includes a forward portion 154 and a rearward portion 130, which is also the integrally-formed action in this alternative embodiment. The sleeve body 150*a* further includes a substantially centrally-disposed aperture 156, the aperture having an internally-threaded portion 134. The sleeve body 150*a* has a pair of apertures 158, 159 each of which is defined vertically within the bottom portion 151 of the sleeve body 150*a*. A pair of fasteners 82, 84 is also provided to secure the sleeve body 150*a* to the stock 20. In application, the rearward threaded portion 42 of the rifle barrel 40 enters the aperture 156 of the sleeve body 150*a* and is threadably received within the threaded portion 134 of the combined sleeve 150 and action 130. In all other respects, operation of the sleeve 150 of the alternative embodiment is the same as operation of the sleeve 50 as was previously described and illustrated in FIG. 3, including the chambering and discharge of the round 70 through the bore 44 of the rifle barrel 40.

Finally, it is to be appreciated by those skilled in the art that either embodiment of the sleeve 50, 150 and the method of the present invention, as described in this detailed description, could be utilized in automatic and semi-automatic rifle platforms without deviating from the scope of the claims that follow.

Based upon the foregoing, it will be seen that there has been provided a new and useful device and method for reducing the adverse effects of barrel vibration and harmonics when the rifle is fired. It will also be seen that such a device and method has been provided whereby the accuracy and consistency in striking a target with a projectile are increased; whereby a minimal number of elements are required for fabrication of the device and whereby the device can be easily mounted within a rifle stock such that a conventional telescopic sight can be added to the device as desired or required by the shooter.

The details of the invention having been disclosed in accordance with the foregoing, I claim:

1. A rifle sub-assembly for use in a rifle assembly, the rifle assembly comprising a rifle barrel, the rifle barrel comprising an externally threaded rearward barrel portion, the rifle sub-assembly comprising: a rifle stock, the rifle stock comprising a proximal shoulder rest portion, a medial portion, a distal grip portion and a slot formed within the stock, the slot comprising a proximal slot portion extending fully through the stock, a medial slot portion, and a distal slot portion; a sleeve body mounted within the medial slot portion of the stock, the sleeve body comprising a rearward portion, a forward portion, and an aperture defined within the sleeve body and extending through the sleeve body from the rearward portion of the sleeve body to the forward portion of the sleeve body, the sleeve body aperture comprising an internally threaded rearward portion and a forward portion; a rifle action, the rifle action comprising a trigger portion, a rearward action portion, and a forward action portion having external threads and internal threads, the external threads of the forward action portion threaded within the internally threaded rearward portion of the sleeve to connect the rifle action to the sleeve such that the trigger portion of the action extends through the proximal slot portion of the stock and protrudes beneath the stock without directly contacting the stock and such that no portion of the action is in direct contact with the stock, the rifle action being cantilevered rearwardly from the rearward portion of the sleeve body above the proximal slot portion of the stock; wherein the externally threaded rearward portion of the barrel is threaded to the internal threads of the forward action portion to secure the rifle barrel to the rifle action such that the rifle barrel is cantilevered forwardly from the forward action portion, above the distal slot portion of the stock, and with no direct contact with the sleeve or the stock when the barrel is combined with the rifle sub-assembly.

2. A method for increasing the accuracy of a rifle, such rifle comprising a rifle stock, a rifle action and a rifle barrel, the rifle action comprising a trigger portion, an externally threaded rearward action portion and an internally threaded forward action portion, the rifle barrel comprising a externally threaded rearward barrel portion, and the rifle stock comprising a proximal shoulder rest portion, a medial portion, a distal grip portion and a slot configured within the stock, the slot comprising a proximal slot portion extending fully through the stock such that the trigger portion of the action protrudes from beneath the stock without directly contacting the stock and such that no portion of the action is in direct contact with the stock, a medial slot portion and a distal slot portion, the medial portion of the slot being located below the sleeve and the distal portion of the slot being located below the barrel, the method comprising the steps of:

providing a sleeve, the sleeve comprising a sleeve body and the sleeve body comprising a rearward portion, a forward portion and an aperture extending through the sleeve body from the forward portion of the sleeve body to the rearward portion of the sleeve body;

forming threads within the internal rearward portion of the sleeve body;

fastening the internally threaded portion of the rifle action to the internally threaded rearward portion of the sleeve body;

mounting the sleeve body to the medial slot portion of the stock such that the rifle action is cantilevered rearwardly from the rearward portion of the sleeve body above the proximal slot portion of the stock and with no direct contact between the stock and the action when the action is fastened to the sleeve; and fastening the externally threaded portion of the rifle barrel to the internally threaded forward portion of the action such that the rifle barrel is cantilevered forwardly from the forward portion of the rifle action above the distal slot portion of the stock and with no direct contact between the sleeve or the stock when the barrel is fastened with the rifle action.

3. A rifle sub-assembly for use in a rifle assembly, the rifle assembly comprising a rifle barrel, the rifle barrel comprising an externally threaded rearward barrel portion, the rifle sub-assembly comprising: a rifle stock, the rifle stock comprising a proximal shoulder rest portion, a medial portion, a distal grip portion and a slot formed within the stock, the slot comprising a proximal slot portion extending fully through the stock, a medial slot portion, and a distal slot portion; a sleeve body mounted within the medial slot portion of the stock, the sleeve body comprising a rearward portion, a forward portion, and an aperture defined within the sleeve body and extending through the sleeve body from the rearward portion of the sleeve body to the forward portion of the sleeve body, the sleeve body aperture comprising a rearward portion and a forward portion; a rifle action, the rifle action comprising a trigger portion, a rearward action portion, and a forward action portion having internal threads, the forward action portion directly connected to the rearward portion of the sleeve such that the trigger portion of the action extends through the proximal slot portion of the stock and protrudes beneath the stock without directly contacting the stock and such that no portion of the action is in direct contact with the stock, the rifle action being cantilevered rearwardly from the rearward portion of the sleeve body above the proximal slot portion of the stock; wherein the externally threaded rearward portion of the barrel is threaded to the internal threads of the forward action portion to secure the rifle barrel to the rifle action such that the rifle barrel is cantilevered forwardly from the forward action portion, above the distal slot portion of the stock, and with no direct contact with the sleeve or the stock when the barrel is combined with the rifle sub-assembly.

4. A rifle comprising:

a rifle action, the rifle action comprising a trigger portion, a rearward action portion and a forward action portion;

a rifle barrel, the rifle barrel comprising a rearward barrel portion;

a rifle stock, the rifle stock comprising a proximal shoulder rest portion, a medial portion, a distal grip portion and a slot configured within the stock, the slot comprising a proximal slot portion extending fully through the stock such that the trigger portion of the action protrudes from beneath the stock without directly contacting the stock and such that no portion of the action is in direct contact with the stock, a medial slot portion and a distal slot portion, the medial portion of the slot being located below the sleeve and the distal portion of the slot being located below the barrel;

a sleeve body, the sleeve body comprising a rearward portion and a forward portion, the sleeve body being mounted to the stock within the medial slot portion; and an aperture defined within the sleeve body and extending through the sleeve body from the rearward portion of the sleeve body to the forward portion of the sleeve body, the sleeve body aperture comprising an internally threaded rearward portion and a forward portion;

the forward portion of the rifle action comprising an externally threaded portion for securing the forward portion of the rifle action within the sleeve body aperture at the rearward portion of the sleeve body such that the rifle action is cantilevered rearwardly from the rearward portion of the sleeve body above the proximal slot portion of the stock and with no direct contact between the stock and the action when the action is combined with the sleeve; and the rearward portion of the barrel comprising an externally threaded portion and the forward portion of the rifle action comprising an internally threaded portion for securing the rearward threaded portion of the rifle barrel to the forward threaded portion of the rifle action such that the rifle barrel is cantilevered forwardly from forward portion of the rifle action above the distal slot portion of the stock and with no direct contact between the sleeve or the stock when the barrel is combined with the rifle action and the rifle action is combined with the sleeve.

* * * * *